US012017745B2

(12) United States Patent
Davidson et al.

(10) Patent No.: US 12,017,745 B2
(45) Date of Patent: Jun. 25, 2024

(54) WORM GEAR ACTUATOR FOR A MARINE STEERING APPARATUS

(71) Applicant: Marine Canada Acquisition Inc., Richmond (CA)

(72) Inventors: Noam Dean Davidson, Vancouver (CA); Payton Chernoff, West Vancouver (CA); Brenden Henriques, Waterloo (CA)

(73) Assignee: Dometic Marine Canada Inc., Richmond (CA)

( * ) Notice: Subject to any disclaimer, the term of this patent is extended or adjusted under 35 U.S.C. 154(b) by 257 days.

(21) Appl. No.: 17/623,940

(22) PCT Filed: Jul. 3, 2020

(86) PCT No.: PCT/CA2020/050934
§ 371 (c)(1),
(2) Date: Dec. 30, 2021

(87) PCT Pub. No.: WO2021/000055
PCT Pub. Date: Jan. 7, 2021

(65) Prior Publication Data

US 2022/0355913 A1 Nov. 10, 2022

Related U.S. Application Data

(60) Provisional application No. 62/870,623, filed on Jul. 3, 2019.

(51) Int. Cl.
*B63H 25/10* (2006.01)
*B63H 25/34* (2006.01)

(52) U.S. Cl.
CPC ..... *B63H 25/10* (2013.01); *B63H 25/34* (2013.01)

(58) Field of Classification Search
CPC ..... B63H 25/00; B63H 25/06; B63H 25/08; B63H 25/10; B63H 25/14; B63H 25/26; B63H 25/34
USPC ..... 114/144 R, 154
See application file for complete search history.

(56) References Cited

U.S. PATENT DOCUMENTS

| | | | | |
|---|---|---|---|---|
| 2,525,240 | A | 10/1950 | Pierce | |
| 7,699,674 | B1 * | 4/2010 | Wald | B63H 25/30 440/58 |
| 7,874,259 | B2 * | 1/2011 | Randle | B60F 3/0007 440/12.5 |
| 8,672,086 | B2 | 3/2014 | Wong et al. | |

(Continued)

FOREIGN PATENT DOCUMENTS

| | | |
|---|---|---|
| GB | 474790 | 11/1937 |

OTHER PUBLICATIONS

International Search Report & Written Opinion of Corresponding PCT Application No. PCT/CA2020/050934 dated Oct. 20, 2020.

*Primary Examiner* — Daniel V Venne
(74) *Attorney, Agent, or Firm* — Calderon, Safran & Wright P.C.

(57) ABSTRACT

Disclosed is an actuator for a marine steering apparatus with steering shaft. The actuator comprises a housing, a gearmotor disposed within the housing, a worm gear disposed within the housing, and a sector gear disposed within the housing. The gearmotor drives the worm gear and the worm gear drives the sector gear. The sector gear transmits torque to the steering shaft of the marine steering apparatus.

21 Claims, 12 Drawing Sheets

(56) References Cited

U.S. PATENT DOCUMENTS

| | | | |
|---|---|---|---|
| 8,795,011 | B2 | 8/2014 | Takase et al. |
| 9,045,212 | B2 | 6/2015 | Kadobayashi et al. |

* cited by examiner

WORM GEAR ACTUATOR FOR A MARINE STEERING APPARATUS

CROSS-REFERENCE TO RELATED APPLICATIONS AND CLAIM TO PRIORITY

This application is a National Phase of International Application No. PCT/CA2020/050934 filed Jul. 3, 2020 which claims priority to U.S. Provisional Patent Application No. 62/870,623 filed Jul. 3, 2019, of which the disclosures are incorporated herein by reference and to which priority is claimed.

TECHNICAL FIELD

The present disclosure relates to an actuator and, in particular, to a worm gear actuator for a marine steering apparatus.

BACKGROUND

U.S. Pat. No. 8,795,011 which issued on Jun. 2, 2015, in the name of Takase et al. discloses a marine vessel propulsion apparatus. The propulsion apparatus includes a transom bracket, a steering shaft, an outboard motor, a tilt mechanism, and a steering mechanism. The steering shaft is joined to the transom bracket, and is turnable around a steering axis extending in an up-down direction. The outboard motor is joined to the steering shaft, turnable around a tilt axis, and turnable around the steering axis together with the steering shaft. The tilt mechanism is arranged to turn the outboard motor around the tilt axis with respect to the steering shaft. The steering mechanism includes a power conversion mechanism arranged to convert power of the electric motor into turning of the steering shaft around the steering axis.

U.S. Pat. No. 9,045,212 which issued on Jun. 2, 2015, in the name of Kadaboyashi et al. discloses an outboard motor suspension device. The suspension device includes a clamp bracket, a tilting shaft, a swivel bracket, a steering shaft, a case, an electric motor, and a transmitter. The electric motor and the transmitter are held in the interior of the case. The electric motor produces power to rotate the steering shaft about a central axis of the steering shaft. The transmitter transmits power from the electric motor to the steering shaft side. The case is located on a placing portion provided on the swivel bracket, and removably attached to the swivel bracket.

SUMMARY

There is provided an actuator for a marine steering apparatus with a steering shaft. The actuator comprises a housing, a gearmotor disposed within the housing, a worm gear disposed within the housing, and a sector gear disposed within the housing. The gearmotor drives the worm gear and the worm gear drives the sector gear. The sector gear transmits torque to the steering shaft of the marine steering apparatus.

The housing may have a first mounting surface, a second mounting surface, and a stepped surface extending between the first mounting surface and the second mounting surface. The housing may have a V-shaped portion and the sector gear may be disposed in the V-shaped portion of the housing. The gearmotor may include a planetary gear arrangement. The gearmotor may be coupled to the worm gear by a spur gear train. The sector gear may be fully disposed within the housing. There may be a printed circuit board disposed on an inner surface of the housing. There may be an MR sensor mounted on the printed circuit board and there may be a linearly magnetized arc magnet mounted on the sector gear.

DESCRIPTION OF SPECIFIC EMBODIMENTS

Figure 1:
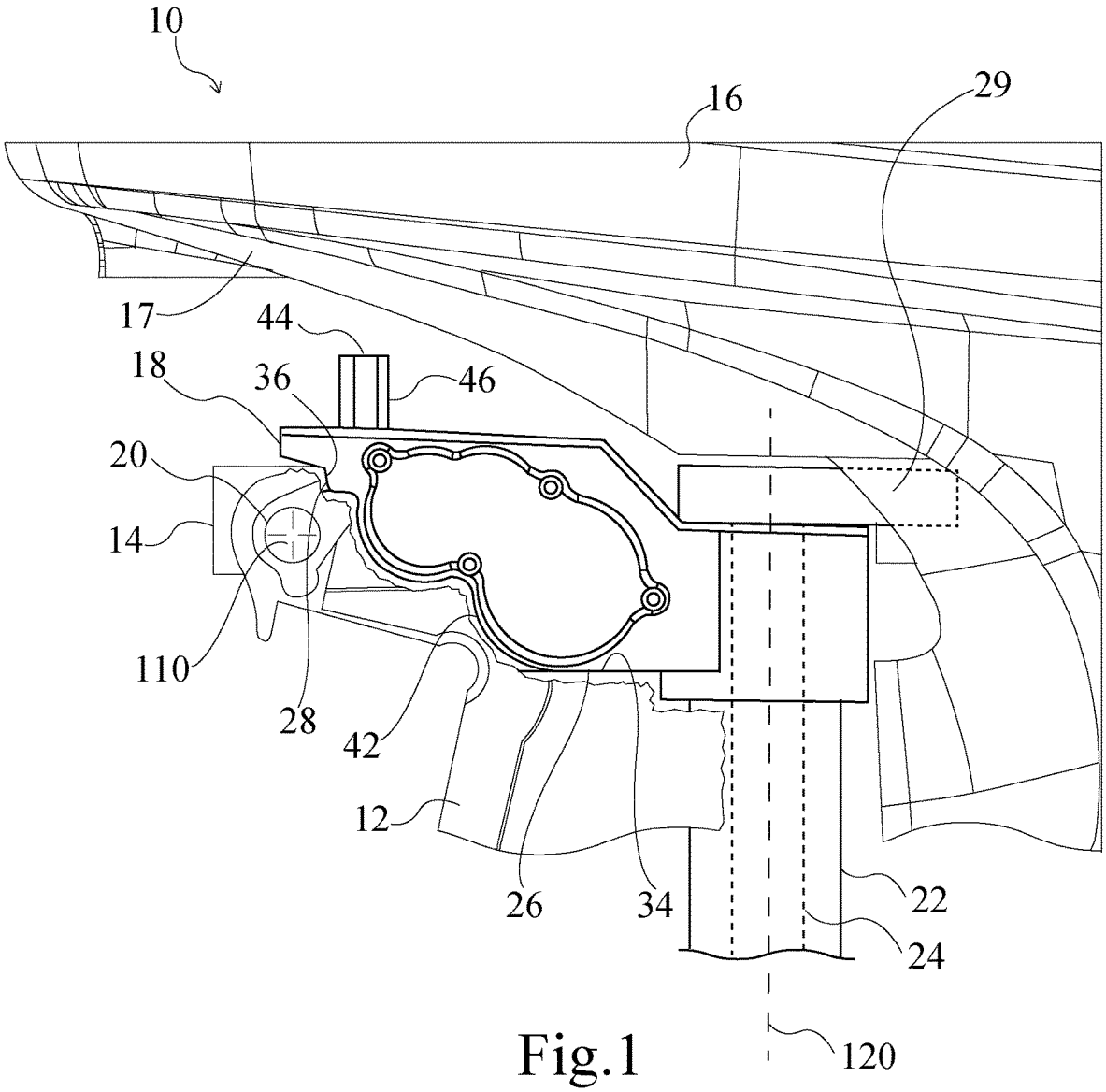
FIG. 1 is an elevation, fragmentary and partially broken away view of a marine steering apparatus.

FIG. 1 shows a marine steering apparatus 10 which generally comprises a transom bracket 12, a swivel bracket 14, a propulsion unit 16, and an actuator 18. The transom bracket 12 is configured to be mounted on a transom of a marine vessel (not shown). The swivel bracket 14 is pivotably coupled to the transom bracket 12 by a tilt tube 20. The tilt tube 20 is coaxial with a tilt axis 110 of the steering apparatus 10. The swivel bracket 14 includes steering shaft housing 22, or downtube, which receives a steering shaft 24 of the propulsion unit 16. The steering shaft 24 is coaxial with a steering axis 120 of the steering apparatus 10. The tilt axis 110 and the steering axis 120 are perpendicular. The swivel bracket 14 also includes a first mounting surface 26 and a second mounting surface 28. The first mounting surface 26 is a horizontal, top surface of the swivel bracket 14. The second mounting surface 28 is a vertical, front surface of the swivel bracket 14. The actuator 18 is mounted on the first mounting surface 26 and the second mounting surface 28 of the swivel bracket 14. The actuator is mounted above the midsection utilizing the current space of a traditional steering arm in standard production outboard engines. The actuator replaces the traditional steering arm. The sector gear 52 acts as the steering arm to rotate engine mount 29. The actuator 18 also further coupled to the steering shaft 24 of the propulsion unit 16. The actuator 18 rotates the steering shaft 24 about the steering axis 120. Rotation of the steering shaft 24 about the steering axis 120 imparts steering motion to the propulsion unit 16 which allows the marine vessel to be steered.

Figure 2:
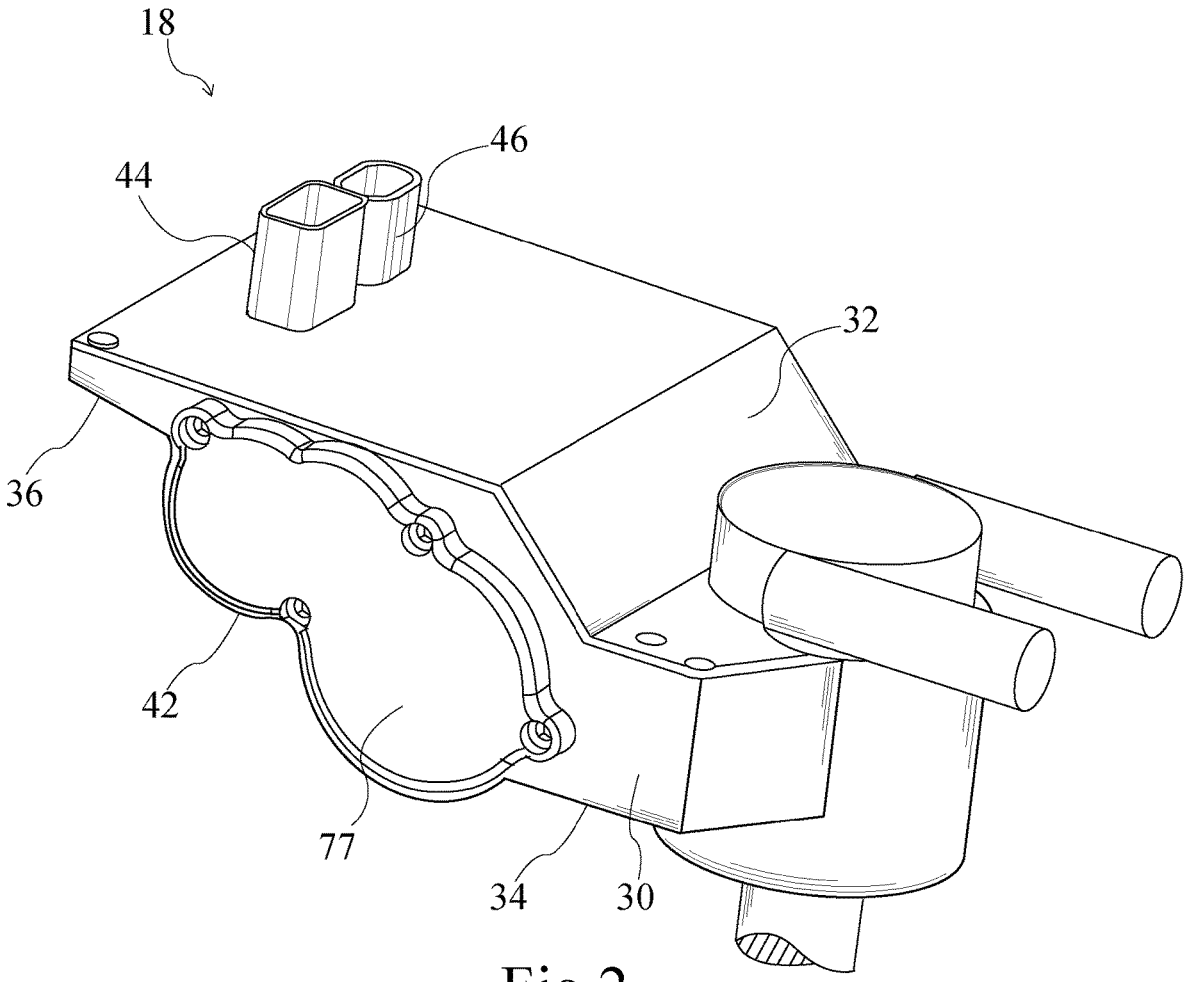
FIG. 2 is a perspective view of an actuator of the marine steering apparatus.
Figure 3:
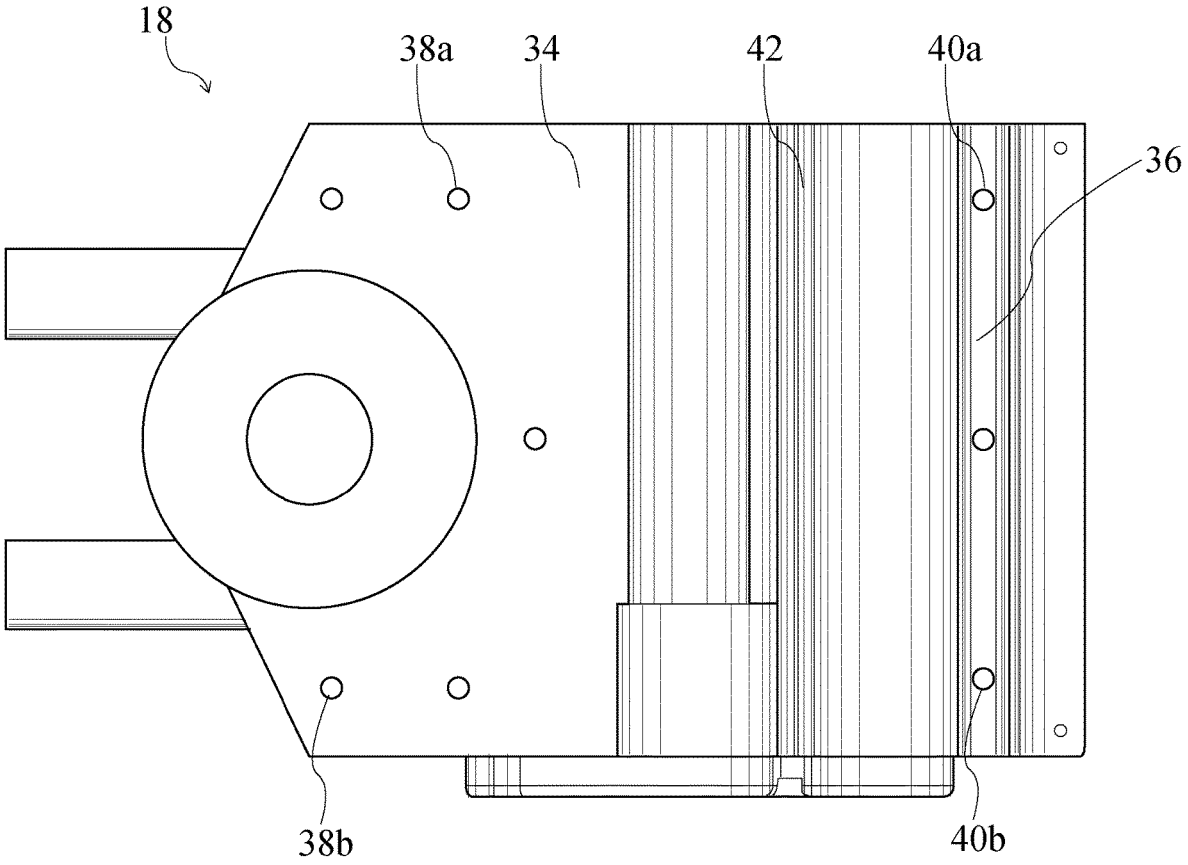
FIG. 3 is a plan view showing mounting surfaces of the actuator.

The actuator 18 is shown in greater detail in FIG. 2. The actuator 18 includes housing 30 and a housing cover 32. The housing 30 has a first mounting surface 34 and a second mounting surface 36. The first mounting surface 34 and the second mounting surface 36, as shown in FIG. 3, are each provided with a plurality of threaded blind holes, for example, threaded blind holes 38*a* and 38*b* as shown for the first mounting surface 34, and threaded blind holes 40*a* and 40*b* as shown for the second mounting surface 36. Referring back to FIG. 2, the housing 30 also has a stepped surface 42 which extends between the first mounting surface 34 and the second mounting surface 36. The stepped surface 42 of the housing 30, as shown in FIG. 1, allows the actuator 18 to fit the shape of the on top and back of transom bracket 12 and the swivel bracket 14 as well as avoid interference with the tilt tube 20 and other structural components below the motor bottom cowling 17. The actuator 18 can tilt with swivel bracket 14 with respect to transom bracket 12 along the tilt axis 110.

The first mounting surface 34 of the actuator 18 is mounted to the first mounting surface 26 of the swivel bracket 14 near the propulsion unit 16. The stepped surface 42 of the actuator 18 extends away from the propulsion unit 16 and towards the tilt tube 20. The second mounting surface 36 of the actuator 18 is mounted to the second mounting surface 28 of the swivel bracket 14 near the tilt tube 20. This configuration result in the actuator 18 being mounted on locations most strongly supported by the swivel bracket 14. This configuration also results in connectors 44 and 46 on the housing cover 32 being disposed away from the propulsion unit 16 to avoid interference.

Figure 4:
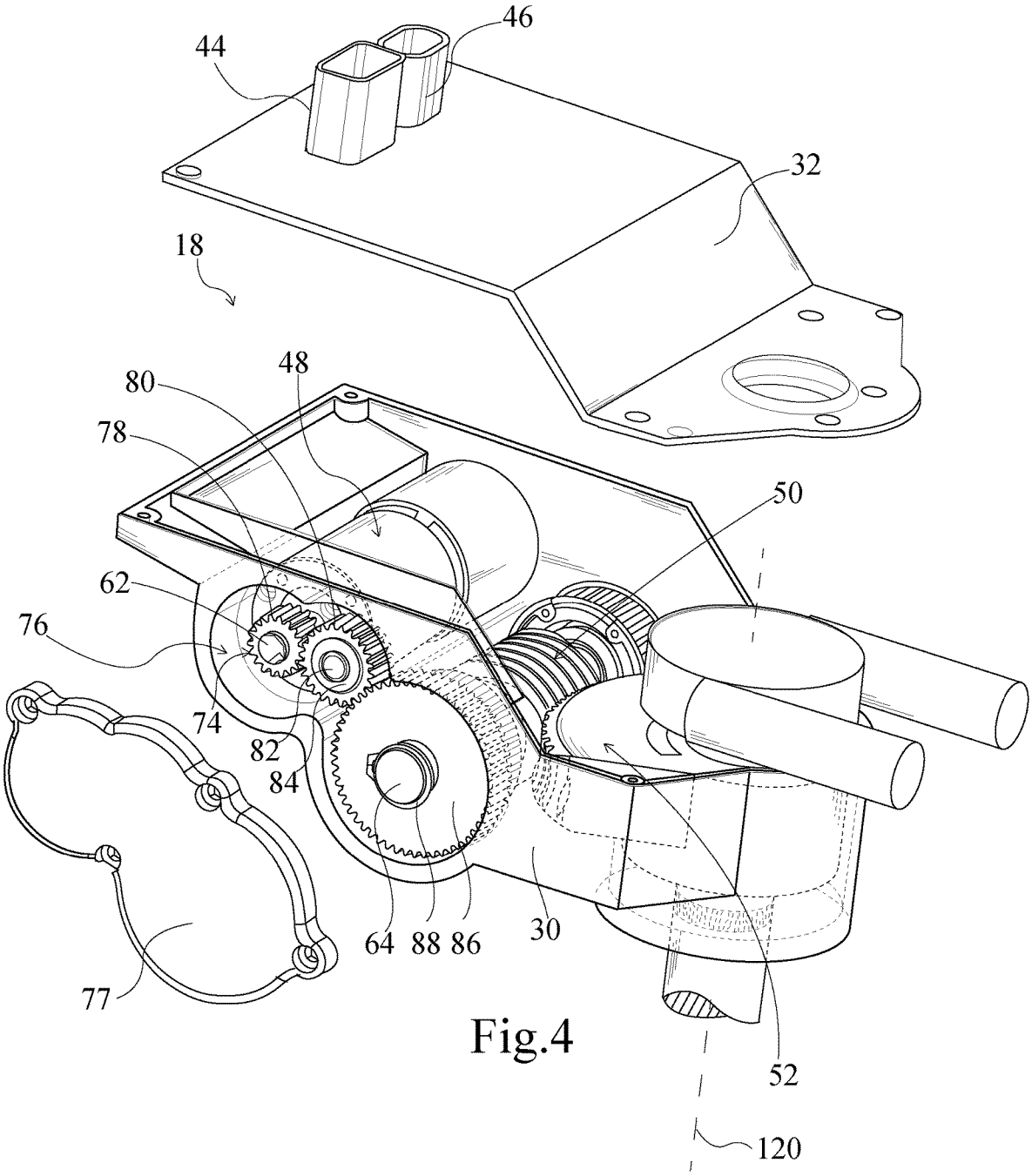
FIG. 4 is a perspective, exploded view of the actuator.
Figure 5:
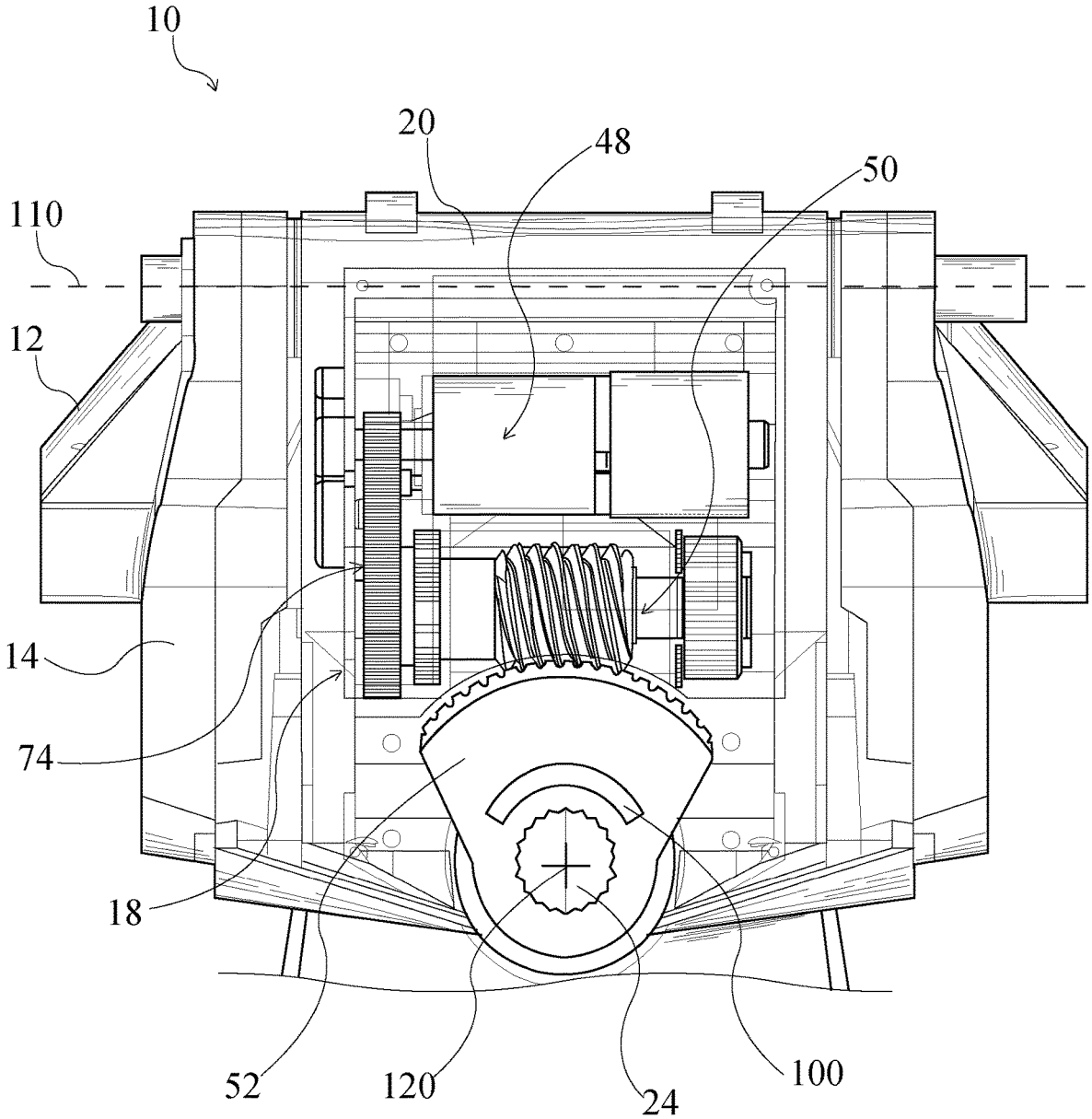
FIG. 5 is a plan, fragmentary and partially broken away view of the marine steering apparatus.

Referring now to FIGS. 4 and 5, the actuator 18 also includes a gearmotor 48, an output shaft 50, and a sector gear 52. The gearmotor 48 drives the output shaft 50 which, in turn, drives the sector gear 52. The sector gear 52 is coaxial with the steering axis 120 and is coupled to the steering shaft 24 of the propulsion unit 16. Reciprocating arcuate motion of the sector gear 52 accordingly transmits torque to the steering shaft 24 which rotates the steering shaft 24 about the steering axis 120, and the sector gear 52 is therefore a torque-transmission gear. Rotation of the steering shaft 24 about the steering axis 120 imparts steering motion to the propulsion unit 16 which allows the marine vessel to be steered. The sector gear 52 is disposed in a V-shaped portion of the housing 30 to allow for a desired arcuate range of the sector gear 52 which, in this example, is one hundred and four degrees to allow for eighty degrees of steering range. However, in other examples, the arcuate range of the sector gear 52 can vary based on steering range desirability or requirements.

Figure 6:
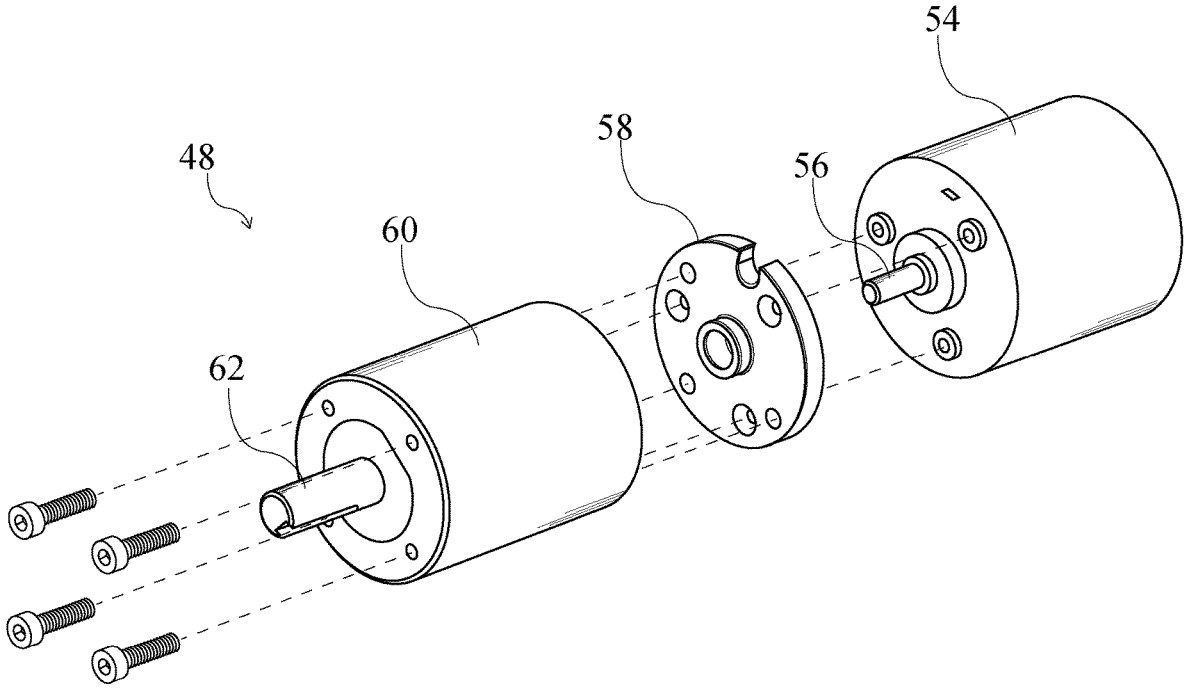
FIG. 6 is an exploded view of a gearmotor of the actuator.
Figure 7:
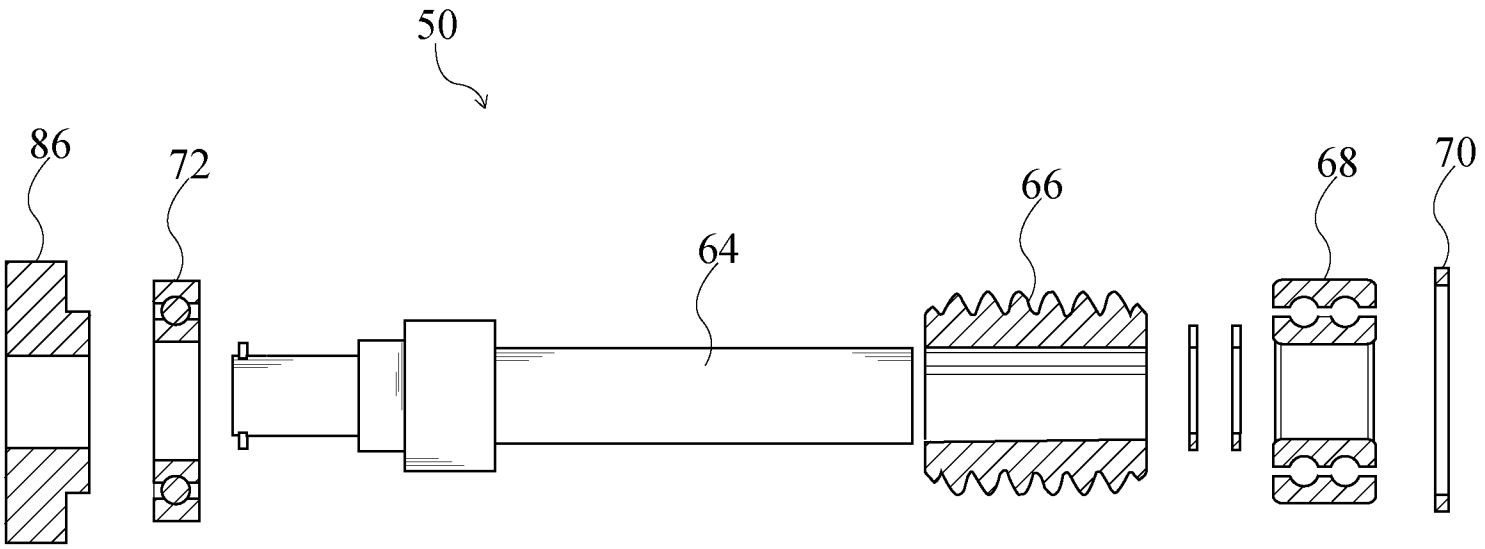
FIG. 7 is an exploded, partially sectional view of an output shaft of the actuator.

The gearmotor 48 and the output shaft 50 are each received in respective bores (not shown) in the housing 30. The gearmotor 48 is bolted to the housing 30 and the output shaft 50 is constrained within the bore using bearings and retaining devices. The gearmotor 48 is shown in greater detail in FIG. 6. The gearmotor 48 includes a motor 54 having a motor output shaft 56. The motor 54 is a brushless DC electric motor, in this example, but any suitable motor may be employed. The gearmotor 48 also includes a coupler plate 58 which couples the motor 54 to a planetary gearbox 60 having a keyed output shaft 62. There is a ~32.5-71.2:1 planetary gearbox reduction, in this example, but any suitable planetary gearbox reduction may be employed. Furthermore, any suitable gearbox reduction, e.g. helical, magnetic, spur, bevel, etc. may be employed. The output shaft 56 of the motor transmits torque to a first planetary arrangement of the planetary gearbox 60. The keyed output shaft 62 of the planetary gearbox 60 transmits an output torque of the gearmotor 48. The output shaft 50 is shown in greater detail in FIG. 7. The output shaft 50 includes a worm shaft 64 and a keyed worm 66 which is fixed axially on the worm shaft 64. There is an angular contact bearing 68 pressed into the output shaft bore. The angular contact bearing 68 is preloaded with an internal retaining ring 70. There is also a single row radial bearing 72 pressed onto a shoulder of the worm shaft 64. In other examples, a bushing may be employed in place of the single row radial bearing 72. The positions of the angular contact bearing 68 and the single row radial bearing 72 may be reversed.

Referring back to FIG. 4, in this example, the gearmotor 48 is coupled to the output shaft 50 by a gear train 74. However, in other examples, the gearmotor 48 may be coupled to the output shaft 50 by a timing belt or another suitable means. The gear train 74 is a spur gear train disposed within a cavity 76 in the housing 30. There is a cover 22 for the cavity 76 in the housing 30. The gear train 74 includes a driving gear 78 mounted on the keyed output shaft 62 of the planetary gearbox 60 of the gearmotor 48. The keyed output shaft 62 of the planetary gearbox 60 of the gearmotor 48 transmits torque to the driving gear 78. The driving gear 78 transmits torque to an idle gear 80 which is rotatably mounted on an extrusion shaft 82 on the housing 30 by a flanged bushing 84. The idle gear 80 is fixed axially on the extrusion shaft 82 by a shoulder (not shown) on the extrusion shaft 82 and an external retaining ring (not shown). The idle gear 80 transmits torque to a driven gear 86 mounted on the worm shaft 64 of the output shaft 50. The driven gear 86 is fixed axially on the worm shaft 64 of the output shaft 50 by a retaining device 88. The driven gear 86 is coaxial with the worm 66. There is a ~3:1 gear train reduction, in this example, but any suitable gear train reduction may be employed.

Figure 8:
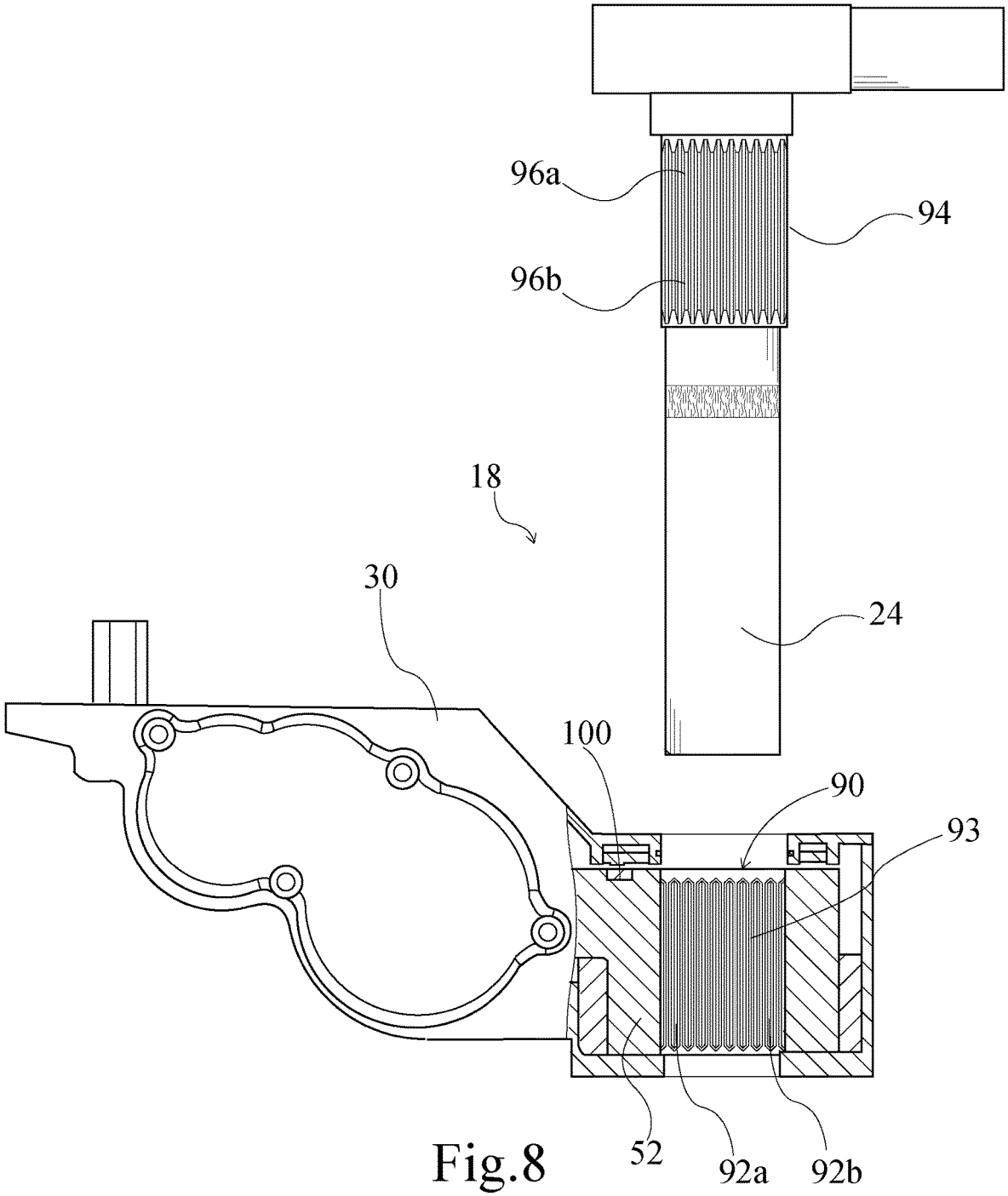
FIG. 8 is an elevation, partially sectional view of the actuator showing a sector gear thereof.
Figure 10:
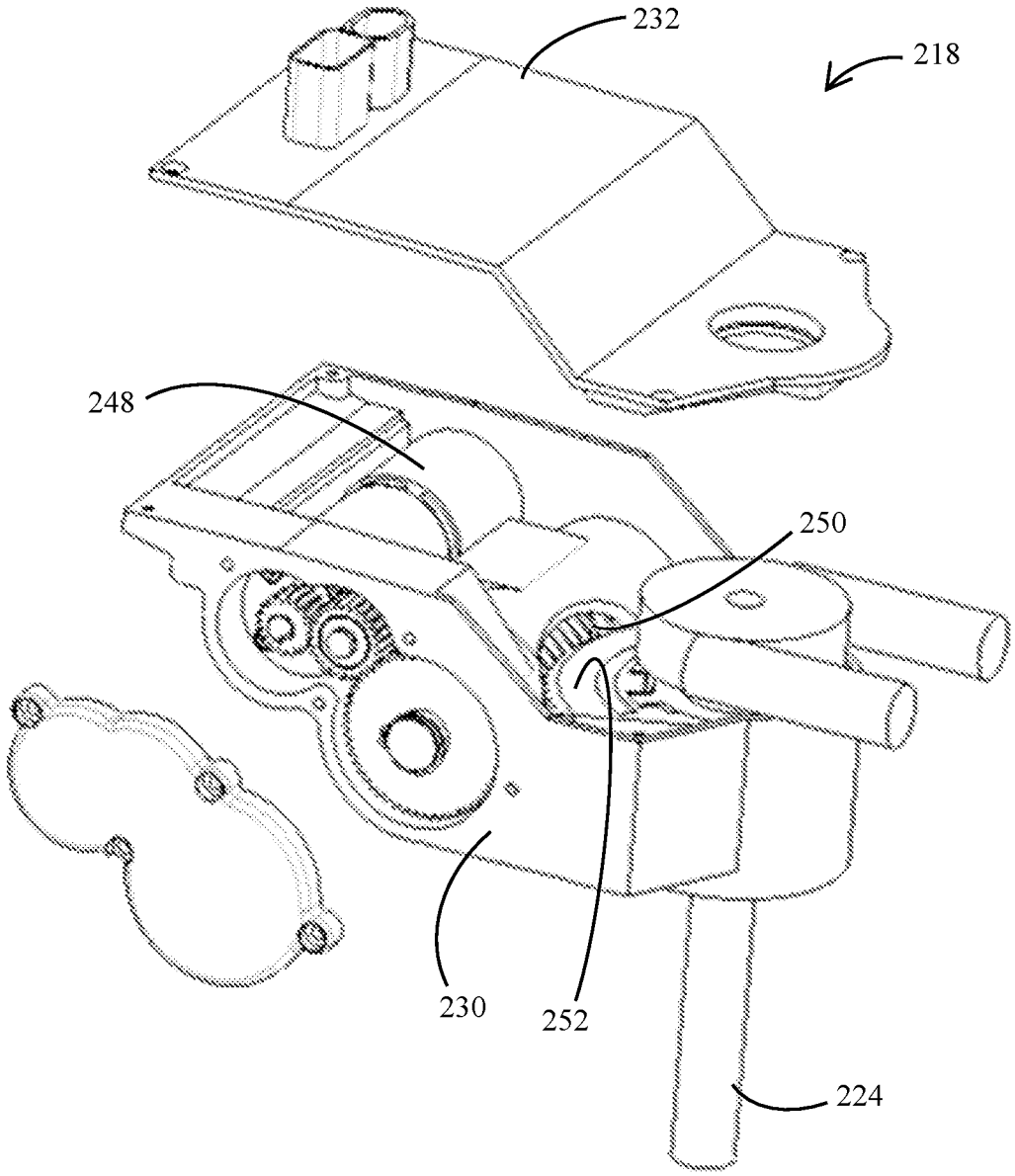
FIG. 10 is a perspective, exploded view of another actuator.
Figure 11:
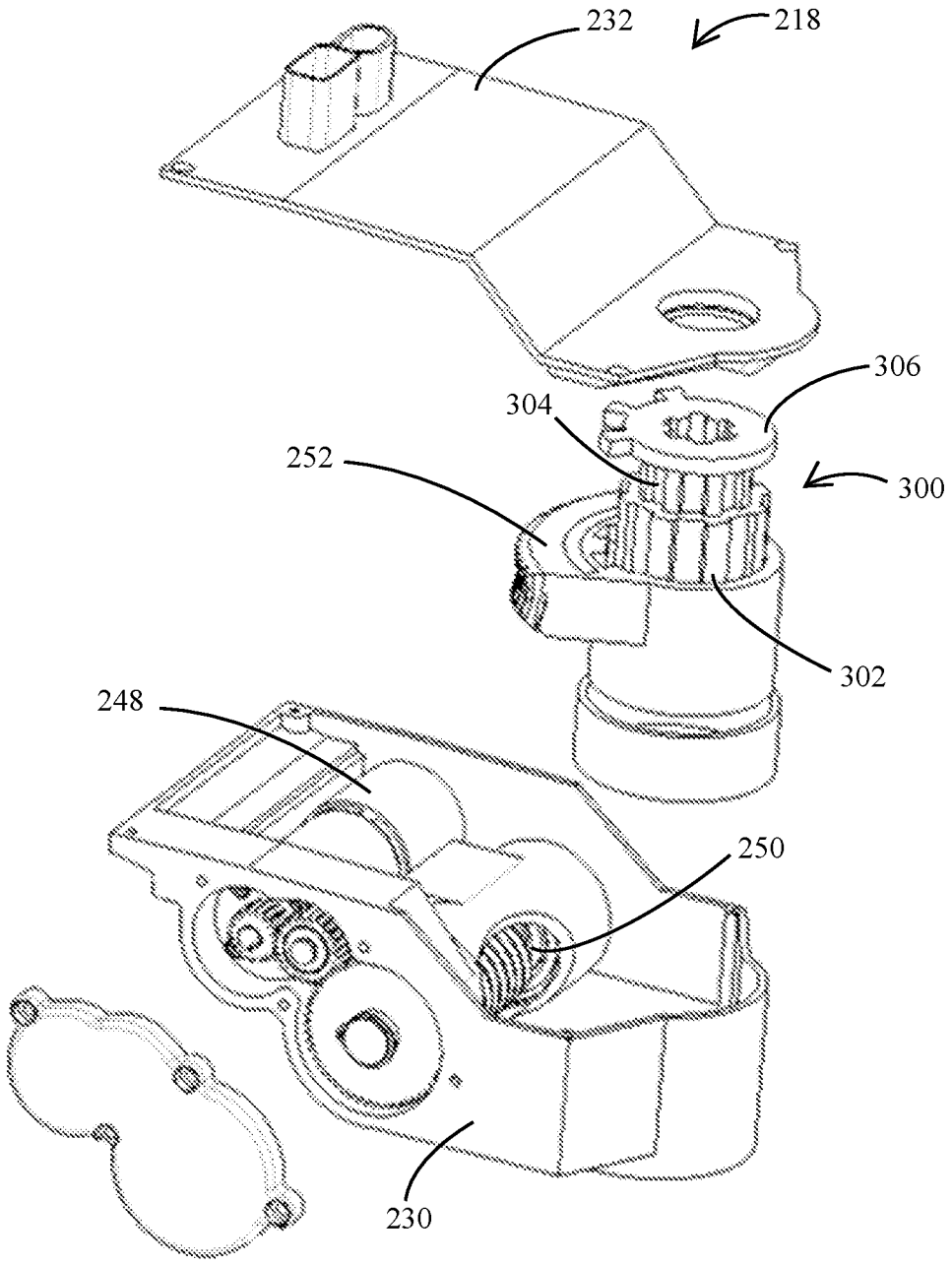
FIG. 11 is another perspective, exploded view of the actuator of FIG. 10.
Figure 12:
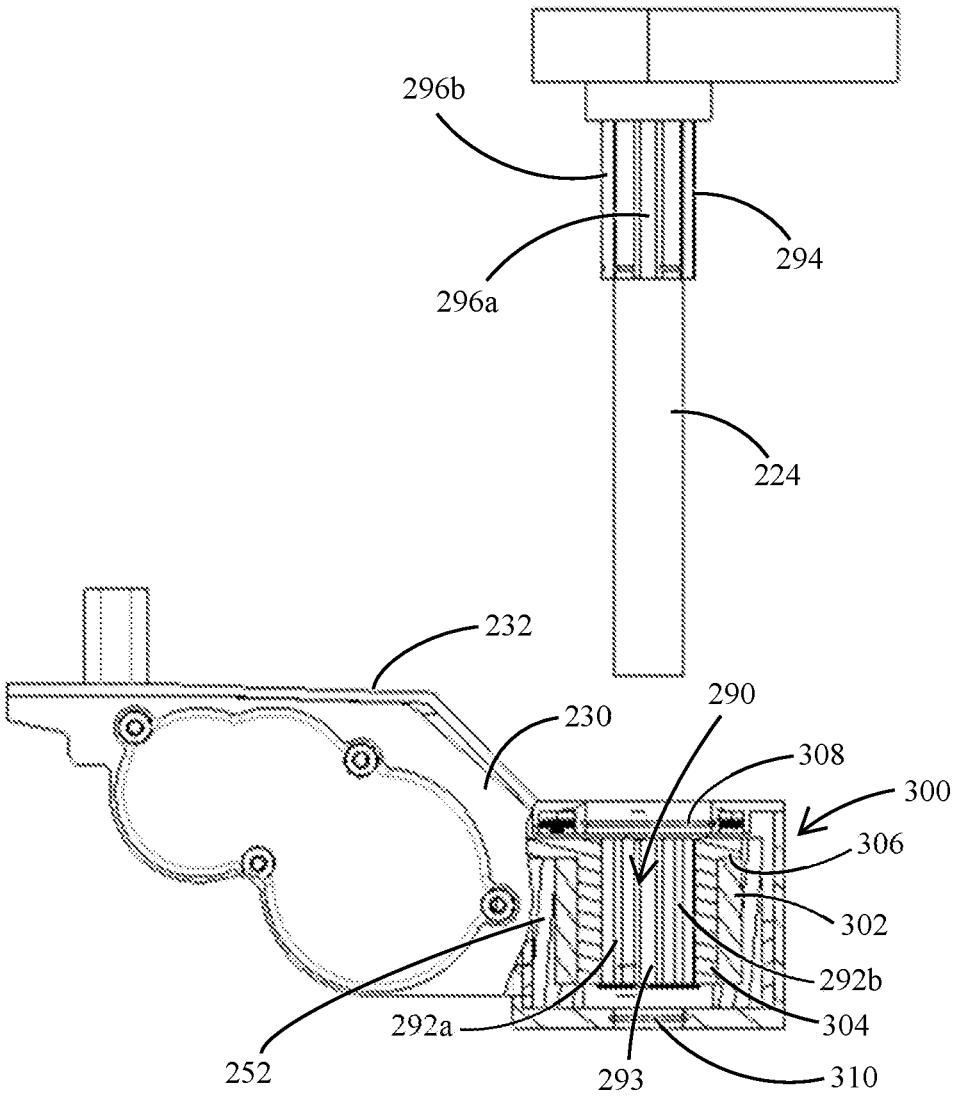
FIG. 12 is an elevation, partially sectional view of the actuator of FIG. 10.

The gearmotor 48 is accordingly coupled to and drives the output shaft 50 which, in turn, drives the sector gear 52. The sector gear 52 is shown in greater detail in FIG. 8. There is an axial bore 90 extending through the sector gear 52. There are internal splines, for example internal splines 92*a* and 92*b*, disposed about an annular wall 93 which defines the axial bore 90. The axial bore 90 receives the steering shaft 24 of the propulsion unit 16 and, in particular, the axial bore 90 receives a splined portion 94 of the steering shaft 24 provided with external splines, for example, external splines 96*a* and 96*b*. The internal splines 92*a* and 92*b*, disposed about the annular wall 93 which defines the axial bore 90, and the external splines 96*a* and 96*b*, on the splined portion 94 of the steering shaft 24, engage to couple the sector gear 52 to the steering shaft 24. The axial bore 90 also allows for the shift and throttle rod (not shown) of the propulsion unit 16 to pass through the actuator 18. FIGS. 10, 11, and 12 illustrate an actuator 218. The actuator 218 includes a housing 230 similar to the housing 30, a housing cover 232 similar to the housing cover 32, a gearmotor 248 similar to the gearmotor 48, an output shaft 250 similar to the output shaft 50, a sector gear (or torque-transmission gear) 252 similar to the sector gear 52, and internal splines 292*a* and 292*b* similar to the internal splines 92*a* and 92*b*. The internal splines 292*a* and 292*b* are disposed about an annular wall 293 similar to the annular wall 93 and defining an axial bore 290 similar to the axial bore 90. The axial bore 290 receives a steering shaft 224 similar to the steering shaft 24. A torsionally compliant coupler 300 may be disposed between internal splines 292*a* and 292*b* on the axial bore 290 and external splines 296*a* and 296*b* similar to the external splines 96*a* and 96*b* on a splined portion 294 (similar to the splined portion 94) of the steering shaft 224, which functions to absorb impact loads and lessen the shock transferred to the mechanical components. The torsionally compliant coupler 300 is composed of a flexible piece 302 and a rigid piece 304. The rigid piece 304 is provided with a mechanical hard stop 306 that limits the amount of torsional movement of the flexible piece 302. In other examples, the sector gear 52 or 252 may be bolted to the steering shaft 24 or 224 or the sector gear 52 or 252 may be coupled to the steering shaft 24 or 224 by another suitable means. There are rotary seals 308 and 310 at the interfaces of the housing 230 of the actuator 218 and the steering shaft 224 to prevent water ingress. The rotary seals 308 and 310 are positioned proximate openings to the axial bore 290 to seal an interior of the housing 230 and to seal the gearmotor 248, the output shaft 250, the sector gear 252, and a portion of the steering shaft 224 within the housing 230 when the axial bore 290 receives the portion of the steering shaft 224.

Figure 9:
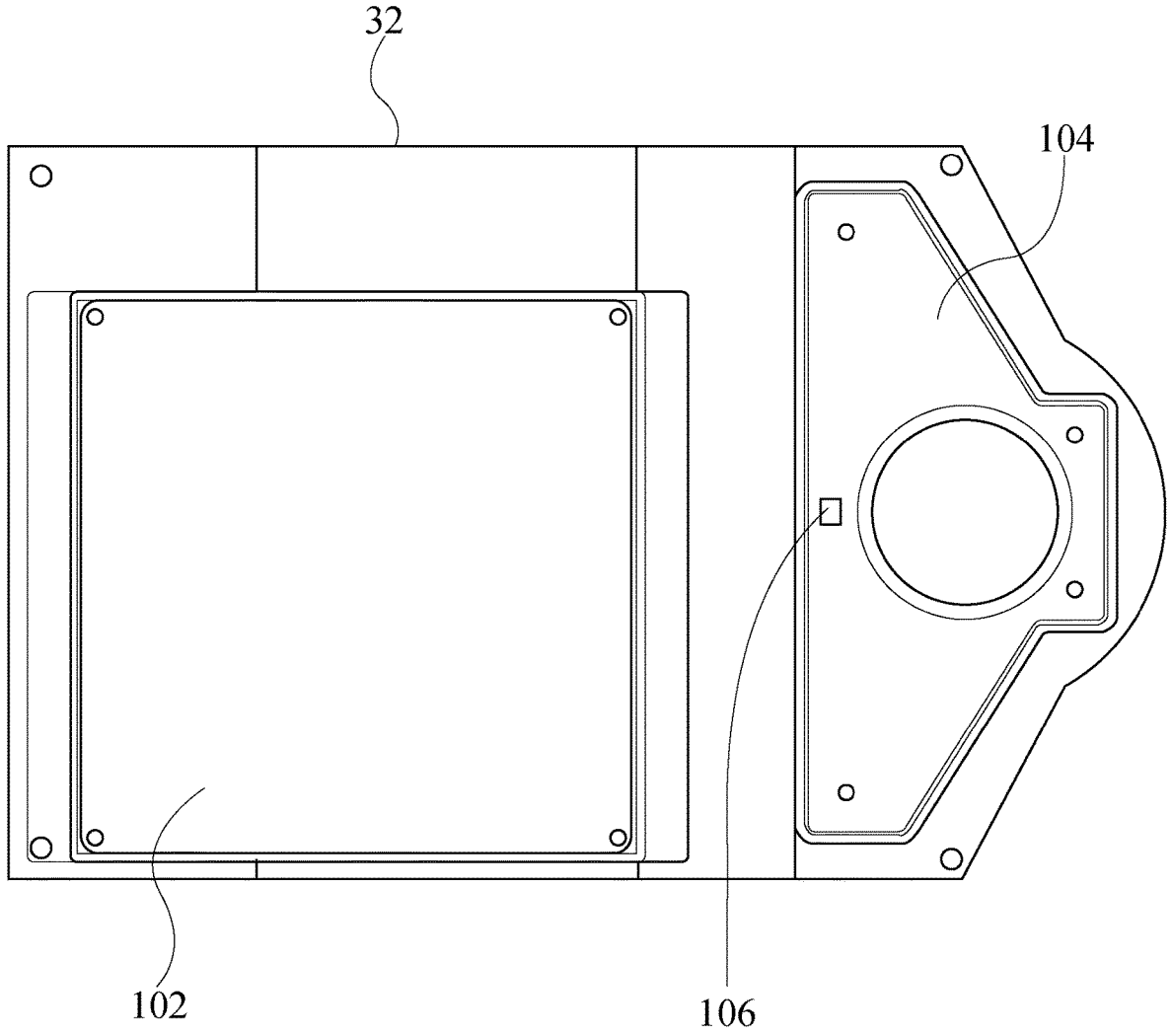
FIG. 9 is a plan view of a cover of the actuator.

The sector gear 52 transmits torque to the steering shaft 24 and thereby applies steering motion to the propulsion unit 16. The sector gear 52 accordingly functions as a tiller arm which is fully housed within the housing 30. The sector gear 52 is tilt-able with the swivel bracket 14 along the axis of the tilt tube 110 with respect to the transom bracket 12. The electronic controls of the actuator 18 are also fully housed within the housing 30. There is a primary printed circuit board 102, shown in FIG. 9, on an inner surface of the housing cover 32 and the connectors 44 and 46, best shown in FIGS. 2 and 3, moulded on the housing cover 32. The connectors 44 and 46 may also be oriented horizontally, protruding to the front and/or the sides of the actuator 18. The connectors 44 and 46 are respectively an electric helm CAN connector and a power connector. The primary printed circuit board 102 is accordingly responsible for communications and power, for example, the primary printed circuit board 102 powers the motor 54. Referring back to FIG. 9, there is also a secondary printed circuit board 104 mounted on the inner surface of the housing cover 32. There is MR sensor 106 mounted on the secondary printed circuit board 104 and, as shown in FIG. 5, there is a linearly magnetized arc magnet 100 mounted on the sector gear 52. The MR sensor 106 and the linearly magnetized arc magnet 100 sense an absolute steering position. In other examples, the primary printed circuit board 102 and the secondary printed circuit board 104 may be mounted on inner walls of the housing. There may also be a printed circuit board mounted on an inner surface (not shown) of the cover 22 for the cavity 76 in the housing 30. The printed circuit board mounted on an inner surface (not shown) of the cover 22 for the cavity 76 in the housing 30 may sense an angular position using magnets mounted on the driving gear 78 and worm shaft 64. There may alternatively be a plastic magnetic worm wheel mounted driven by finer threads on the worm shaft 64. The actuator 18 accordingly has a sealed housing with integrated electronic controls and mechanical components.

It will be understood by a person skilled in the art that many of the details provided above are by way of example only, and are not intended to limit the scope of the invention which is to be determined with reference to the following claims.

What is claimed is:

1. An actuator for a marine steering apparatus comprising a steering shaft, the actuator comprising:

a housing;

a gearmotor disposed within the housing;

a worm gear disposed within the housing;

a torque-transmission gear disposed within the housing, wherein the gearmotor comprises an output shaft coupled to the worm gear such that the gearmotor drives the worm gear in response to a torque from the output shaft of the gearmotor, the worm gear is coupled to the torque-transmission gear such that the worm gear drives the torque-transmission gear in response to the torque from the output shaft of the gearmotor, and when the torque-transmission gear is coupled to the steering shaft, the torque-transmission gear transmits torque to the steering shaft in response to the torque from the output shaft of the gearmotor; and a flexible piece positioned to absorb impact loads between the torque-transmission gear and the steering shaft when the torque-transmission gear is coupled to the steering shaft.

2. The actuator as claimed in claim 1, wherein the housing has a first mounting surface, a second mounting surface, and a stepped surface extending between the first mounting surface and the second mounting surface.

3. The actuator as claimed in claim 1, wherein the housing has a V-shaped portion and the torque-transmission gear is disposed in the V-shaped portion of the housing.

4. The actuator as claimed in claim 1, wherein the gearmotor includes a planetary gear arrangement.

5. The actuator as claimed in claim 1, wherein the gearmotor is coupled to the worm gear by a spur gear train.

6. The actuator as claimed in claim 1, wherein the torque-transmission gear is fully disposed within the housing.

7. The actuator as claimed in claim 1, further including a printed circuit board disposed on an inner surface of the housing.

8. The actuator as claimed in claim 7, further including a MR sensor mounted on the printed circuit board and a linearly magnetized arc magnet mounted on the torque-transmission gear.

9. The actuator as claimed in claim 1, wherein the housing defines at least one opening configured to receive a portion of the steering shaft from outside of the housing.

10. The actuator as claimed in claim 9, wherein the housing surrounds the at least one opening such that the housing surrounds the portion of the steering shaft when the at least one opening receives the portion of the steering shaft.

11. The actuator as claimed in claim 9, further comprising at least one seal positioned proximate the at least one opening to seal an interior of the housing when the at least one opening receives the portion of the steering shaft.

12. The actuator as claimed in claim 11, wherein when the at least one opening receives the portion of the steering shaft, the at least one seal seals, within the housing, the gearmotor, the worm gear, the torque-transmission gear, and the portion of the steering shaft.

13. The actuator as claimed in claim 1, further comprising the marine steering apparatus, wherein the torque-transmission gear is coupled to the steering shaft such that the torque-transmission gear transmits the torque to the steering shaft in response to the torque from the output shaft of the gearmotor.

14. The actuator as claimed in claim 1, further comprising a rigid piece comprising a mechanical hard stop that limits an amount of torsional movement of the flexible piece.

15. The actuator as claimed in claim 1, wherein the torque-transmission gear is a sector gear.

16. An actuator for a marine steering apparatus comprising a steering shaft, the actuator comprising:

a housing;

a gearmotor disposed within the housing;

a worm gear disposed within the housing;

a torque-transmission gear disposed within the housing, wherein the gearmotor comprises an output shaft coupled to the worm gear such that the gearmotor drives the worm gear in response to a torque from the output shaft of the gearmotor, the worm gear is coupled to the torque-transmission gear such that the worm gear drives the torque-transmission gear in response to the torque from the output shaft of the gearmotor, and when the torque-transmission gear is coupled to the steering shaft, the torque-transmission gear transmits torque to the steering shaft in response to the torque from the output shaft of the gearmotor; and a torsionally compliant coupler to absorb impact loads between the torque-transmission gear and the steering shaft when the torque-transmission gear is coupled to the steering shaft.

17. The actuator as claimed in claim 16, wherein the torque-transmission gear is a sector gear.

18. A marine steering apparatus comprising:

a transom bracket configured to be mounted on a transom of a marine vessel;

a swivel bracket pivotably coupled to the transom bracket;

a steering shaft;

an actuator supported by the swivel bracket such that the actuator is tiltable with the swivel bracket relative to the transom bracket, the actuator comprising:

a housing;

a gearmotor disposed within the housing;

a worm gear disposed within the housing; and a torque-transmission gear disposed within the housing, wherein the gearmotor comprises an output shaft coupled to the worm gear such that the gearmotor drives the worm gear in response to a torque from the output shaft of the gearmotor, the worm gear is coupled to the torque-transmission gear such that the worm gear drives the torque-transmission gear in response to the torque from the output shaft of the gearmotor, and when the torque-transmission gear is coupled to the steering shaft, the torque-transmission gear transmits torque to the steering shaft in response to the torque from the output shaft of the gearmotor;

wherein:

the torque-transmission gear is coupled to the steering shaft such that the torque-transmission gear transmits the torque to the steering shaft in response to the torque from the output shaft of the gearmotor;

the swivel bracket comprises a first mounting surface and a second mounting surface;

the housing has a first mounting surface, a second mounting surface, and a stepped surface extending between the first mounting surface of the housing and the second mounting surface of the housing;

the first mounting surface of the housing is mounted to the first mounting surface of the swivel bracket; and the second mounting surface of the housing is mounted to the second mounting surface of the swivel bracket.

19. The marine steering apparatus of claim 18, further comprising a propulsion unit, wherein rotation of the steering shaft about a steering axis relative to the transom bracket imparts steering motion to the propulsion unit relative to the transom.

20. The marine steering apparatus of claim 18, wherein:

a portion of the steering shaft is received in the housing;

the actuator further comprises at least one seal positioned to seal an interior of the housing; and the gearmotor, the worm gear, the torque-transmission gear, and the portion of the steering shaft are sealed within the housing.

21. The marine steering apparatus of claim 18, wherein the torque-transmission gear is a sector gear.

* * * * *